United States Patent [19]

New

[11] Patent Number: 4,529,086

[45] Date of Patent: Jul. 16, 1985

[54] DEVICE FOR CONVEYING ARTICLES OF CLOTHING

[75] Inventor: Charles R. New, Perth, Australia

[73] Assignee: Surbiton Pty, Ltd., Perth, Australia

[21] Appl. No.: 511,215

[22] Filed: Jul. 6, 1983

[30] Foreign Application Priority Data

Jul. 29, 1982 [AU] Australia ..... PF5119

[51] Int. Cl.[3] ..... B65D 85/18

[52] U.S. Cl. ..... 206/287.1; 206/292; 223/96

[58] Field of Search ..... 206/292, 297, 298, 299, 206/287, 287.1, 293; 223/72, 84, 95, 96; 211/118, 119

[56] References Cited

U.S. PATENT DOCUMENTS

| | | | |
|---|---|---|---|
| 736,426 | 8/1903 | Nagely | 223/96 |
| 1,452,456 | 4/1923 | Crupain | 206/292 X |
| 1,493,294 | 5/1924 | Timberlake | 211/119 X |
| 1,618,157 | 2/1927 | Harmon | 211/119 X |
| 1,938,921 | 12/1933 | Meyer | 223/84 X |
| 3,054,541 | 9/1962 | Wilson | 223/96 |
| 4,253,577 | 3/1981 | Macfarlane | 211/118 |

FOREIGN PATENT DOCUMENTS

| | | | |
|---|---|---|---|
| WO82/02868 | 9/1982 | World Intel. Prop. Org. | 206/292 |
| 601340 | 5/1948 | United Kingdom | 223/72 |
| 733380 | 7/1955 | United Kingdom | 206/298 |

*Primary Examiner*—Robert R. Mackey

*Attorney, Agent, or Firm*—Holman & Stern

[57] ABSTRACT

A device to hold and hang garments, particularly trousers, and to maintain them ironed in any type of travelling bag, even in small soft bags, comprises at least two, preferably rectangular, frames of metallic wire, the long inner sides of which are both hinged in one central sleeve. Each outer long side of said frames is formed of overlapping portions of wire and is inserted in a separate sleeve. A third frame with a top hook can also be hinged in said central sleeve. The device can be inserted into an envelope-like container.

7 Claims, 17 Drawing Figures

DEVICE FOR CONVEYING ARTICLES OF CLOTHING

BACKGROUND OF THE INVENTION

1. Field of the Invention

The present invention relates to a method and a device to carry trousers and to maintain them in order and ironed, even in soft travelling bags.

2. Statement of the Prior Art

Conventional suit-frames or coat hangers are useful when utilized in wardrobes or rigid travelling cases and provided there is a hook from which they may be hung. However, even if there is a hook, they keep the trousers in order and ironed only if they are placed vertically in a wardrobe or if there is a uniform lateral pressure, such as the weight of other suits. Moreover, they require that the height of the suit-case is equal at least to the sum of the height of the hanger plus one half of the length of the trousers, (i.e. a minimum height of approximately 60 centimeters). The present trend is towards small, soft travelling cases or foldable sacks, which can be used as cabin luggage in aircraft. In some cases, the maximum height permitted for such luggage is around 45 centimeters. To successfully use conventional suit-frames or hangers requires a travelling bag which is taller than 60 centimeters; is partially stiff; and is provided with a hook. Usually soft bags are not fitted with hooks, however, even if the conventional hangers could be hung within these soft bags, the trousers inside could not be kept in order and ironed. Unless the suit-holder is self-supporting, it is generally not possible to maintain the trousers in order and ironed in soft bags. In addition, conventional hangers are useless when the trousers have to be laid horizontally, for instance in a drawer, or piled as if they were shirts.

BRIEF SUMMARY OF THE INVENTION

It is an object of the present invention to provide a device for holding and hanging suits and trousers, which avoids the above mentioned disadvantages and is foldable and self-sustaining.

It is another object of the invention to provide a device which is foldable, self-sustaining, light, not cumbersome and is able to be inserted into a plastic container to better separate the trousers and to keep them in order and uncreased.

A further object of the invention is to provide a method to hold and hang trousers.

The device, according to the invention, is characterized in that it consists of at least two frames, one frame having one side only connected by a hinge with one side only of the other frame, so that the frames may move around the hinge like the covers of a book.

According to a preferred feature of the invention, the device consists of two frames of rectangular shape, one of the long sides of a frame being coupled by a hinge with one of the long sides of the other frame, the length of the long sides of both frames being the same while the height of the minor sides of one frame is slightly higher than that of the other frame.

According to a further preferred feature of the invention, the hinge is formed by a common sleeve in which one long side of each frame is disposed. Preferably, the other longest sides of the frames are inserted in sleeves.

Preferably, the device of the invention, when in closed position, either loaded or unloaded, is inserted into an envelope-like container.

According to a further preferred feature of the invention, a third frame provided with a top hook is hinged to the other two frames.

In another form, the invention resides in a method to hold trousers and maintain them in order and ironed comprising the steps of;

- placing the device of the form described above, in its open position, on the trousers, symmetrically in respect of the length of the laid trousers;
- turning the end portions of the trousers inwardly over the two external sleeves; closing inwardly the frames, and possibly inserting the so closed frames in a container.

BRIEF DESCRIPTION OF THE DRAWINGS

The invention will be fully understood in the light of the following description of several preferred, but not limiting, embodiments shown in the accompanying drawings wherein.

DETAILED DESCRIPTION

Figure 1:
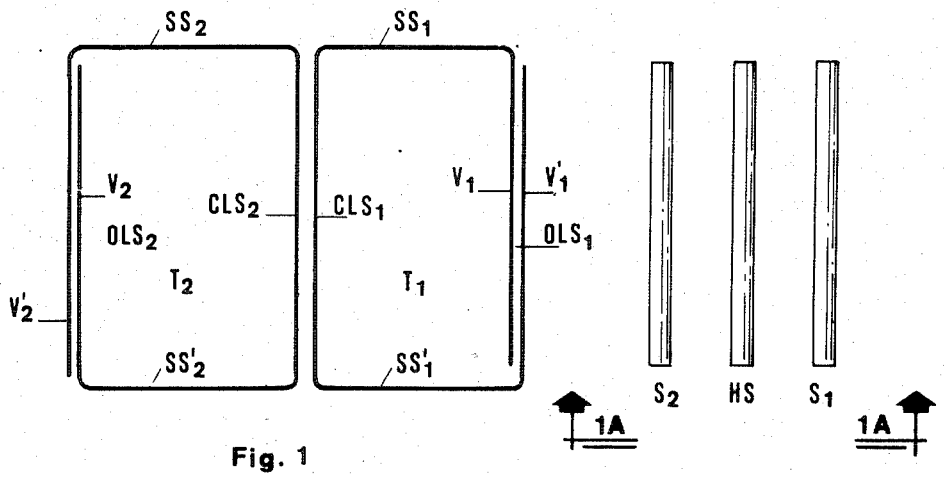
FIG. 1 is a top or front view of the separate elements forming the device of one embodiment.
Figure 2:
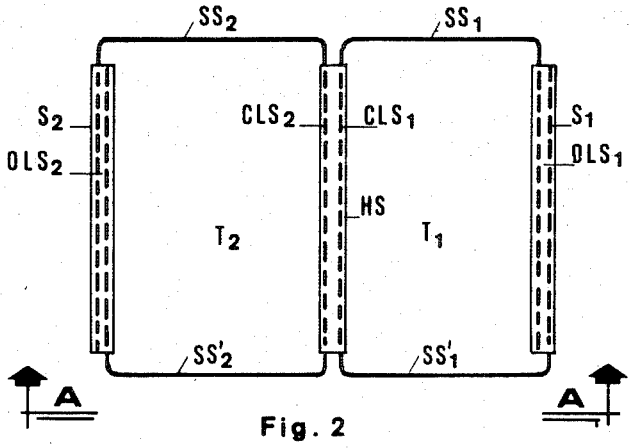
FIG. 2 is a front elevational view of the embodiment of FIG. 1 in assembled form.
Figure 3:
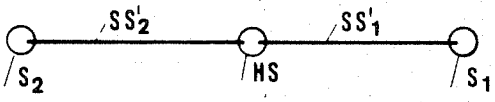
FIG. 3 is a view, from line A—A, of FIG. 2.
Figure 5:
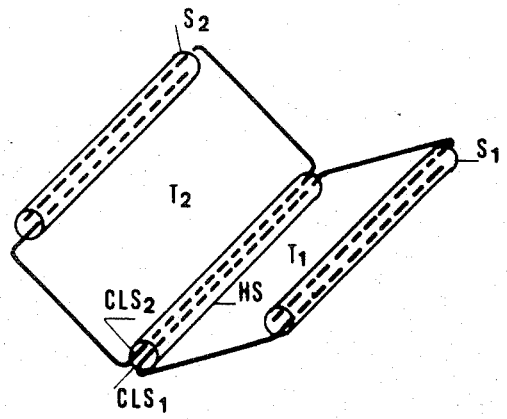
FIG. 5 is a perspective view of the embodiment of FIG. 1 in assembled form.

FIG. 1 shows the separate elements of the device of the first embodiment which consists of two frames T1 and T2 held together along one of their longest sides, CLS1 and CLS2, by a sleeve HS acting as a hinge. The other longest sides of the frames T1 and T2 are covered by the sleeves S1 and S2. FIGS. 2 and 5 show the elements of FIG. 1 in their assembled form. The two frames T1 and T2 are similar, each consisting (in the case of a preferred rectangular form) of two longer sides CLS1 and OLS1 for T1, and CLS2 and OLS2 for T2, and of two shorter sides SS1 and SS1' for T1, and SS2 and SS2' for T2. Characteristically, the outer longer sides OLS1 of T1 and OLS2 of T2 are formed each of two overlapping portions V1—V1' and V2—V2'. In a preferred embodiment, each frame T1 and T2 is obtained by bending four times a harmonic steel wire having, e.g., a diameter from 1 to 4 millimeters, preferably of 2.5 millimeters in order to have the necessary elasticity. The tubular sleeves have an internal diameter, e.g., of from 0.1 to 8 millimeters, depending on the size and number of steel wires they have to lodge, and are made by extrusion of a resin material selected from the group including polyolefins, PVC, polyamides, polycarbonates, polystyrene, and mixtures of these possibily added with another plastomer or elastomer.

Figure 1A:
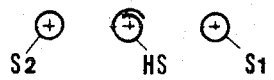
FIG. 1A is a view taken from line 1A—1A of only the sleeves of FIG. 1.

The central sleeve HS (covering at least two inner sides) has the function of a hinge, the lateral sleeves S1 and S2 (covering each a single long side) allow the trousers to slide over the frames without sticking to them. The same sleeves S1 and S2 close and fasten the two overlapping wire portions of each outer longer side OLS1, OLS2. The cross-section of the sleeves are shown in FIG. 1A; while lateral sleeves S1 and S2 are longitudinally closed cylinders, central hinge sleeve HS consists of overlapping portions forming a longitudinal aperture through which the inner long sides CLS1 and CLS2 can be inserted withn HS.

Figure 15:
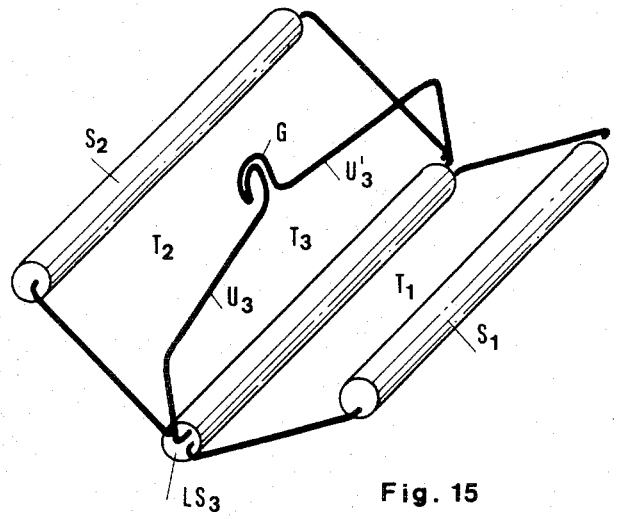
FIG. 15 is a perspective view similar to FIG. 5 illustrating a second embodiment.
Figure 16:
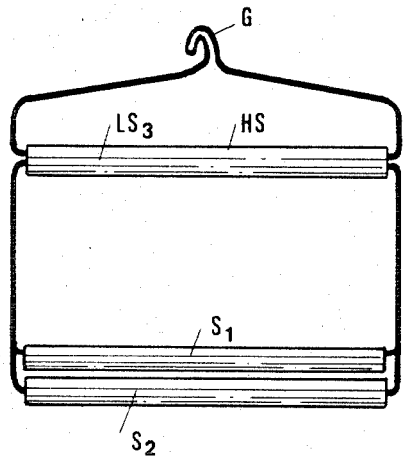
FIG. 16 is an elevational view of the embodiment of FIG. 15 in the folded condition.

According to an advantageous feature of the invention, a third frame T3 (FIGS. 15 and 16) can be hinged in said sleeve HS. The upper sides of the third frame, U3 and U3' are bent to form a hook G to hang the device. Preferably, the third frame is made by bending and shaping suitably a carbon steel wire, possibly coated with a thin layer of plastic material of any composition conventionally used to cover metallic wires.

In a practical embodiment of the trousers holder according to the invention, the two frames T1 and T2 have a length of the long sides of about 41 centimeters, and a length of the short sides of about 21 centimeters.

The steel wire of frames T1 and T2 has a diameter of about 2.5 millimeters while all the sleeves have an internal diameter of 5.5 millimeters, except in the case that the third frame T3 is hinged in the sleeve HS, in which case the internal diameter of sleeve HS is suitably higher, in order to contain the wire of T3, which can be also plastic coated.

Figure 6:
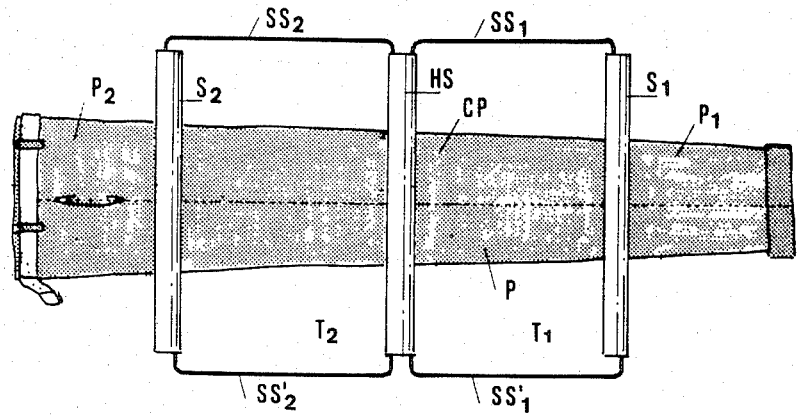
FIGS. 6 to 14 are various views, illustrating the steps of the method of hanging trousers over the embodiment of FIG. 1 and of inserting the so loaded embodiment in a container.
Figure 7:
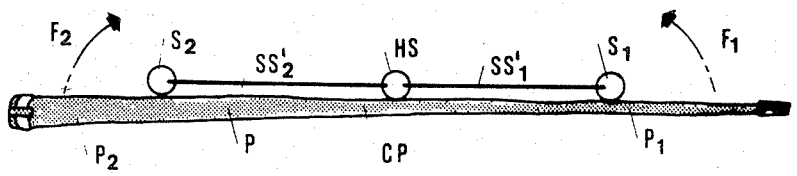
Figure 8:
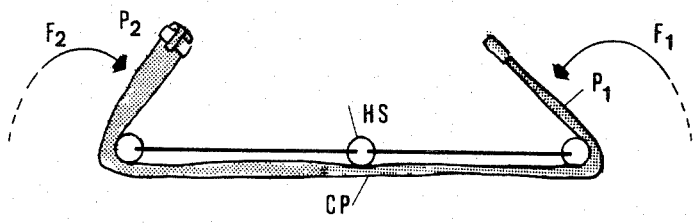
Figure 9:
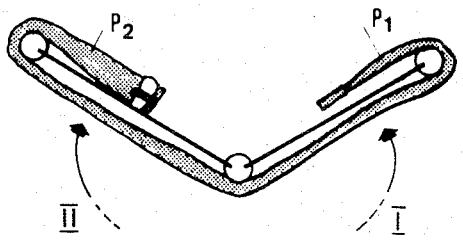
Figure 10:
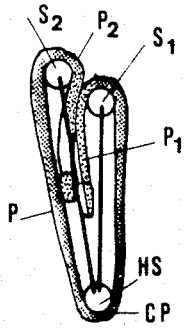
Figure 11:
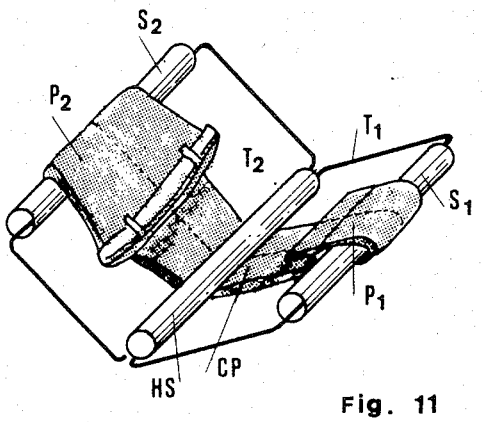
Figure 12:
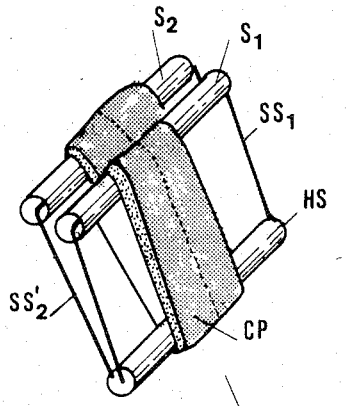

The method of utilizing the device to hold trousers is shown in FIGS. 6 to 14. The device is placed in its open position of FIG. 2 on trousers P laid, e.g., horizontally in such a way that the central sleeve HS is roughly on the central portion of the trousers length (FIGS. 6 and 7). The portions P1 and P2 outside the sleeves S1 and S2 are then turned inwardly over the sleeves in the directions of the arrows F1 and F2 as shown in FIG. 8. The whole device is then collapsed according to arrows I and II (FIGS. 9 and 11) whereby the device takes the shape of a closed book (FIGS. 10 and 12).

Figure 13:
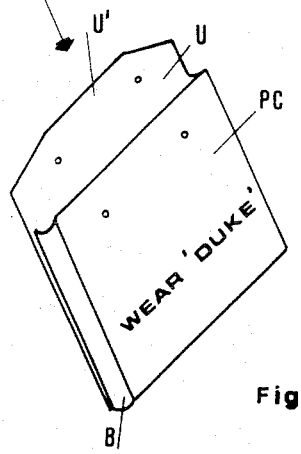
Figure 14:
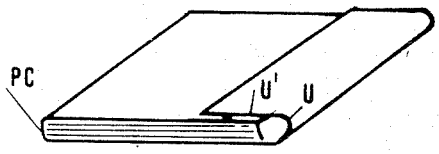

According to a further advantage of the invention, the trousers holder, in its closed position, either loaded or unloaded, is inserted in a thin container PC closed at bottom B and opened at the top U (FIG. 13). The top mouth U of the container can be closed by turning down the extension U' after the insertion of the supported trousers as shown in FIG. 14. The container PC can be made of textile or plastic material and is preferably transparent to permit recognition of the contained trousers. If desired, the containter PC can be printed with advertising slogans.

It will be appreciated that the trousers P are bent three times whereby the height of the loaded device in its closed position is slightly above the length of the short side of the frames, i.e. this length plus twice the thickness of the bent trousers. Accordingly, the encumbrance of the loaded container is very low,, (e.g., around 33 centimeters) and the trousers holder can be easily fitted into a small (office) case.

On the contrary, the conventional suit-carriers need a travelling bag having a height equal to the sum of the height of the hanger plus half the length of the trousers, i.e. a bag at least 60 centimeters high. Moreover, said big bags had to be at least semi-rigid while the device of the invention allows now not only to carry and maintain ironed trousers in much smaller bags but also to use the presently more popular soft bags due to the fact that the device is self-sustaining.

Figure 4:
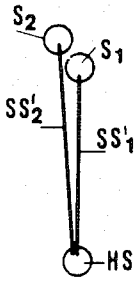
FIG. 4 is a view similar to FIG. 3 of the embodiment of FIG. 1 in its closed position.

Finally, the device of the invention has nearly no volume in its unloaded condition (See FIG. 4) while when loaded with trousers, as in FIGS. 10 and 12, and inserted in container as in FIG. 14, it can easily be accommodated or disposed not only in travelling bags but also in drawers and it takes approximately only the room of a ironed shirt.

I claim:

1. A flexible, deformable and pressure resistant garment holding device to hold and support garments, particularly trousers, and to maintain them in a pressed, unwrinkled condition in travelling bags, particularly soft bags and sacks, comprising:

two rectangular frames each formed of a single length of steel wire bent four times, each frame having two long sides and two short sides, one of said long sides of each frame being a central long side and the other outer long side being formed at least partly by overlapping end portions of the steel wire, said long sides having substantially the same length and the short sides of one frame having a slightly different length than the short sides of the other frame;

a central sleeve of tubular plastic material loosely enclosing at least partially said central long sides to form a hinge means so that said frames are pivotable with respect to each other substantially about the longitudinal axis of said central sleeve; and two sleeves of tubular plastic material each loosely enclosing at least partially one of the outer long sides having overlapping end portions.

2. A garment holding device as claimed in claim 1 wherein said central sleeve comprises a tubular member having overlapping edge portions forming a longitudinal slot.

3. A garment holding device as claimed in claim 1 wherein said sleeves enclose substantially all of the lengths of the respective long sides.

4. A garment holding device as claimed in claim 3 wherein said overlapping end portions of the steel wire forming said outer long sides of each frame each have a length slightly less than the length of the long sides.

5. A garment holding device as claimed in claim 4 wherein said short sides have a difference in length at least sufficient to allow one frame to freely pass through the other frame and to allow both frames, one inside the other, to lie in substantially the same plane with the garment thereon folded over said outer long sides.

6. A garment holding device as claimed in claim 1 wherein said short sides have a difference in length at least sufficient to allow one frame to freely pass through the other frame and to allow both frames, one inside the other, to lie in substantially the same plane with the garment thereon folded over said outer long sides.

7. A garment holding device as claimed in claim 1 and further comprising a thin flexible rectangular envelope container made of transparent plastic material having long and short sides of greater length respectively than said long and short sides of said frames and a thickness approximately equal to the external diameter of said sleeves plus twice the thickness of the garment folded around the sleeves, said container being closed at the bottom and open at the top so that the frames with a garment thereon can be inserted into the container, and a flap to close said open top.

* * * * *